United States Patent [19]

Glass

[11] 4,368,548

[45] Jan. 18, 1983

[54] NESTABLE UNDERCUT BEDPAN

[76] Inventor: Henry P. Glass, 245 Dickens Rd., Northfield, Ill. 60093

[21] Appl. No.: 342,285

[22] Filed: Jan. 25, 1982

Related U.S. Application Data

[63] Continuation of Ser. No. 228,294, Jan. 26, 1981, abandoned.

[51] Int. Cl.[3] ..... A61G 9/00

[52] U.S. Cl. ..... 4/451; 4/450; 4/455

[58] Field of Search ..... 4/450, 451, 455, 456, 4/144.1, 300.2, 449, 452, 454, 457, 479, 300, 483; 220/23.6; D24/57

[56] References Cited

U.S. PATENT DOCUMENTS

| | | | |
|---|---|---|---|
| D. 22,967 | 12/1893 | Gulick | D24/57 |
| D. 173,490 | 11/1954 | Jones | D24/57 |
| D. 216,058 | 11/1969 | Painter et al. | D24/57 |
| D. 216,059 | 11/1969 | Rickmeier, Jr. | D24/57 |
| D. 246,055 | 10/1977 | Mills | D24/57 |
| 760,229 | 5/1904 | Meinecke et al. | 4/450 |
| 884,842 | 4/1908 | Nelson | 4/456 X |
| 931,539 | 8/1909 | William et al. | 4/450 |
| 1,132,056 | 3/1915 | Poindexter | 4/456 X |
| 1,156,172 | 10/1915 | Wesley et al. | 4/456 |
| 3,246,344 | 4/1966 | Saulson | 4/455 |
| 3,460,164 | 8/1969 | Patton | 4/451 |
| 3,464,066 | 9/1969 | Marks | 4/451 |
| 3,503,080 | 3/1970 | Laufer et al. | 4/451 |
| 3,597,771 | 8/1971 | Rickmeier, Jr. | 4/450 |
| 3,840,906 | 10/1974 | Huggins | 4/451 |
| 3,846,840 | 11/1974 | Dooley et al. | 4/451 |
| 3,962,732 | 6/1976 | Mills | 4/451 |

FOREIGN PATENT DOCUMENTS

| | | | |
|---|---|---|---|
| 992403 | 5/1965 | United Kingdom | 4/451 |

*Primary Examiner*—Henry K. Artis

*Attorney, Agent, or Firm*—Dressler, Goldsmith, Shore, Sutker & Milnamow, Ltd.

[57] ABSTRACT

An injection-molded nestable bedpan having a cavity defining a receptacle formed by a bottom wall and a tapered upright wall, and a seat formed at the upper edge of said upright wall. The tapered upright wall includes opposed sidewall segments and opposed end wall segments with one of the tapered end wall segments defining an undercut to inhibit splashback and spillage.

11 Claims, 7 Drawing Figures

Fig. 1.
(PRIOR ART)
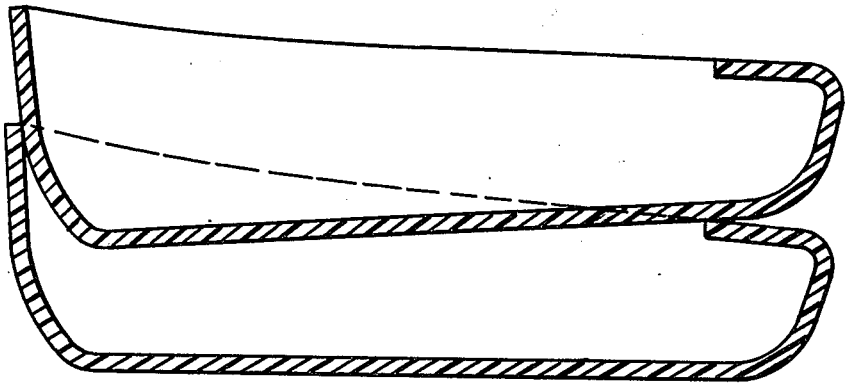
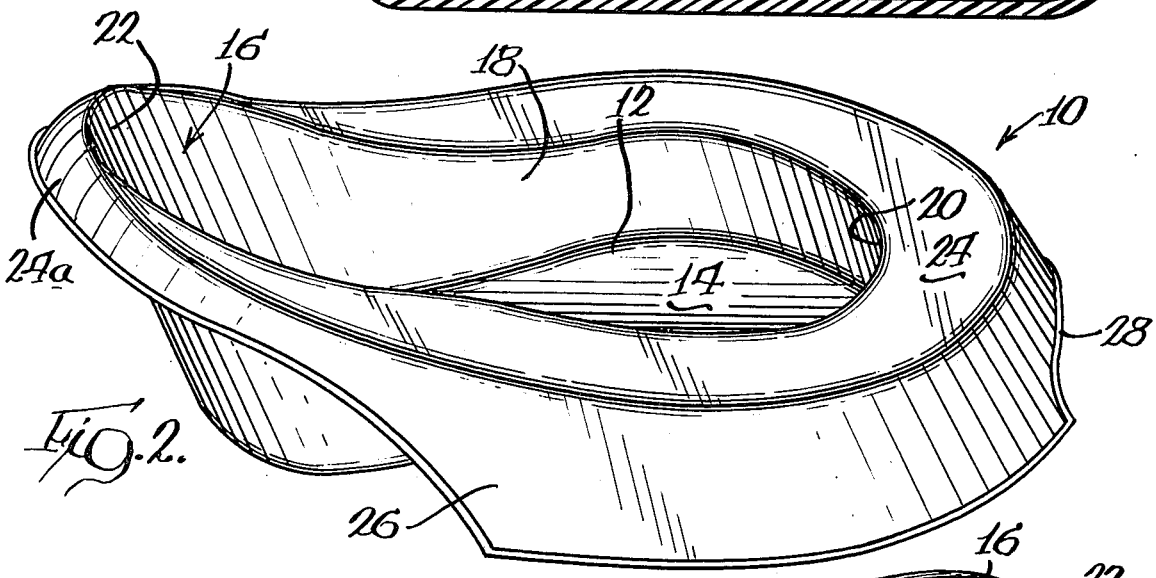
Fig. 2.
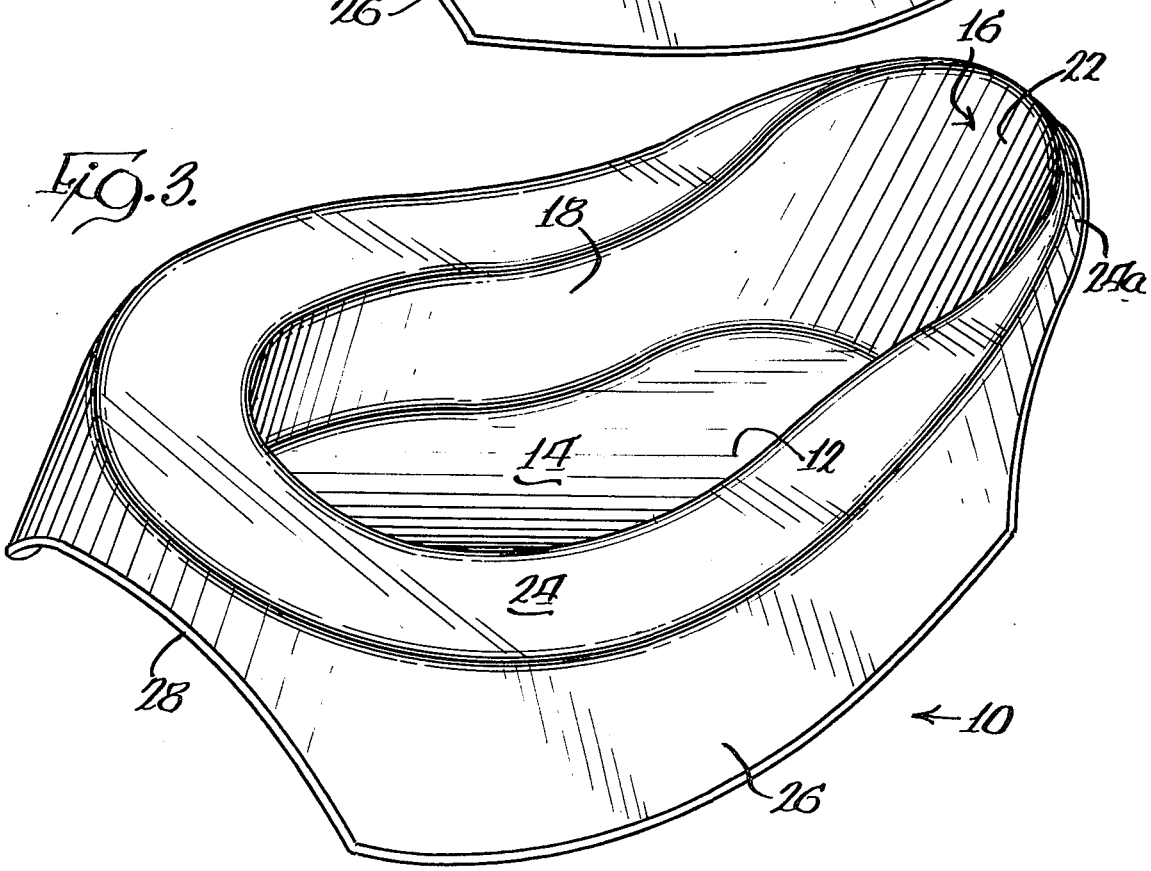
Fig. 3.

6.
26
10
20
16
18
24a
28
5.
5.
28
24
18
22
12

10
24
6.
12
24a
28
T
18
20
22
A
B
14

12
10
20
26
26
18
18
14

10
24a
24
20
12
18
10
28
22
D
14
10

NESTABLE UNDERCUT BEDPAN

This is a continuation, of application Ser. No. 228,294 filed Jan. 26, 1981, now abandoned.

TECHNICAL FIELD

This invention relates generally to bedpans and more particularly relates to bedpans such as injection-molded single-patient use bedpans which can be fully nested and which simultaneously are undercut to prevent splashback and spills.

BACKGROUND OF THE INVENTION

The necessity of bedpans for bed-ridden patients is of course well-known. The practice of the principal users of bedpans, institutions such as hospitals and nursing homes, is to utilize disposable products, i.e., products discarded after use by one patient (also known as single-patient use products). As a result, many products have had to change in order to permit production thereof at low costs commensurate with single-patient use. Bedpans are no exception.

A bedpan basically consists of a cavity defining a receptacle and a seat portion to support a patient. At one time bedpans were generally made of metal. The basic shape and configuration of such bedpans was generally similar to those shown in Jones U.S. Design Pat. No. D-173,490, and Saulson U.S. Pat. No. 3,246,344. In such "standard" bedpans, the seat portions extend inwardly from the peripheral wall to define a generally central opening accessing the receptacle.

One of the advantages of this design was its anti-splashback characteristics particularly during transportation. The overhanging inwardly directed seat would inhibit splashback and spillage of the contents when a bedpan was being moved after use. While some bedpans were later made of a plastic material in order to reduce costs, the basic configuration remained unchanged.

Both of these types of bedpans were relatively expensive and therefore were not disposable, i.e., they were intended for multiple-patient use. As such, it was necessary to autoclave or sterilize them before they could be reused. The resulting costs were high, both acquisition costs because of the material used and/or cost of production, and the cost of use was high as a result of the requirements and the expenses of sterilization.

Clearly, if a single-patient use or disposable bedpan could be produced to satisfy the needs of the institutions which are the most prevalent users thereof, it would be expected that such a bedpan would be received with great enthusiasm. Such was the case.

Thus, when a bedpan such as that disclosed in Painter U.S. Design Pat. No. D-216,058 first appeared on the market, it was well received even though it did not "look" like a bedpan. The Painter bedpan was advantageous in that it was injection-molded and therefore was inexpensive to make. Because of its configuration, a plurality of such bedpans could be nested one within the other, to minimize the amount of storage space required.

One problem with the Painter et al. bedpan, however, derived directly from the manufacturing technique used and the resulting low cost. Because it was injection-molded, it was designed with the seat portion extended outwardly from the walls of the receptacle rather than inwardly as did the then "standard" bed pans. Not only did this result in a bedpan which had a somewhat different appearance from the standard bedpan, but the tapering walls of the receptacle portion and the outwardly directed seat did not provide any undercut or catch to prevent splashback and spills. In spite of this, the bedpan was widely used because it was uniquely adaptable to single-patient use and because of the reduced storage space required due to its nestability.

Subsequently, bedpans such as those disclosed in Rickmeier Design Pat. No. D-216,059, and Rickmeier Pat. No. 3,597,771, appeared on the market. These bedpans, which were designed to permit injection-molding, also had an undercut portion to inhibit splashback and spills. While this feature was, in fact, desirable from the user's standpoint, more space was required to store a supply of such bedpans than was required to store the Painter type bedpans because the Rickmeier style would not nest (See FIG. 1). Thus, hospitals were faced with a choice between a type of single-patient use bedpan that would store in a minimum amount of space but which did not have a desired antisplashback capability and a bedpan having such a capability but which required increased amount of space to store because of its inability to nest.

Other configurations of bedpans which would facilitate nesting were also in existence. See, e.g., British Pat. No. 992,403. However, just as in Painter, no such bedpan of which applicant is aware really inhibited splashback. Even the British bedpan, which included a projecting transverse barrier in the bottom of the container portion to inhibit surging of the contents when the bepan was being carried did not inhibit splashback and spillage. In order to prevent spillage, this bedpan was provided with some type of flexible cover that was placed over it when it was carried.

Clearly, none of the bedpan configurations discussed above and disclosed in the above-mentioned patents truly solved the problem of providing an inexpensive, one piece nestable bedpan which would incorporate an undercut to inhibit splashback and spillage. The desirability of such a bedpan is evident although to applicant's knowledge, there exists today no such configuration which is low in cost and suitable for single patient use and which provides the undercut and the nestable advantages which are so desirable.

SUMMARY OF THE INVENTION

In accordance with the present invention there is provided a bedpan sufficiently inexpensive to be suitable for single-patient use, which is nestable, and which also includes an undercut portion to inhibit splashback and spillage. The bedpan incorporating the present invention is configured to permit injection-molding thereof and thereby minimize the cost of production. At the same time such bedpans can be nested and incorporate an undercut to inhibit splashback and spillage.

Thus, the bedpan of the present invention solves a long-standing need for a product which became apparent at least ten years ago with the introduction of the injection-molded bedpan of the type disclosed in the aforementioned Painter et al. patent and the ever increasing practice of hospitals and other institutions to utilize single-patient or disposable bedpans.

While it is known that the nestability of a product can be obtained by sloping walls inwardly so that the bottom or closed portion is smaller than the top or open portion by at least the thickness of the material used, (such as, for example, the bedpan disclosed in the aforementioned Painter design patent), the bedpan of the present invention achieves this nestable configuration while providing at one end of the container portion an undercut to inhibit splashback.

Thus, in accordance with the present invention, the cavity defining the receptacle portion of the bedpan is formed by a bottom wall and an upright wall extending up from the peripheral edge of the bottom wall. The upright wall has an opposed pair of sidewall segments which taper downwardly and inwardly as normal, as well as an opposed pair of end wall segments, one of which tapers down and in and the other one of which tapers down and out to define an undercut. The tapering end wall segment defining the undercut is angled in the same direction as is the end wall segment opposite therefrom whereas in the usual product, such walls are slanted in opposite directions.

The configuration of the bedpan of the present invention not only provides the desired undercut but the relationship between the angles of the opposed end wall segments, one of which defines the undercut, as well as the remaining portions of the bedpan permit a plurality of such bedpans to be nested one within the other and also permit inexpensive production thereof, such as by injection-molding.

Thus, the bedpan incorporating the present invention incorporates all of the capabilities and characteristics desired by the users of such products—namely, low cost, nestability to minimize storage space, and an undercut to inhibit splashback and spillage. All these features, together with the enhanced appearance of such a product and the functional strength provided by depending wings and peripheral beads surrounding the upper edges thereof, produce a bedpan having a configuration which solves a long-felt need in the medical products industry.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

BRIEF DESCRIPTION OF THE DRAWING

FIG. 1 is a cross-sectional view illustrating the nesting limitations of a prior art type bedpan and corresponds to FIG. 9 of Rickmeier U.S. Pat. No. 3,597,771;

FIGS. 2 and 3 are perspective views of a bedpan incorporating the present invention;

DETAILED DESCRIPTION

Figure 4:
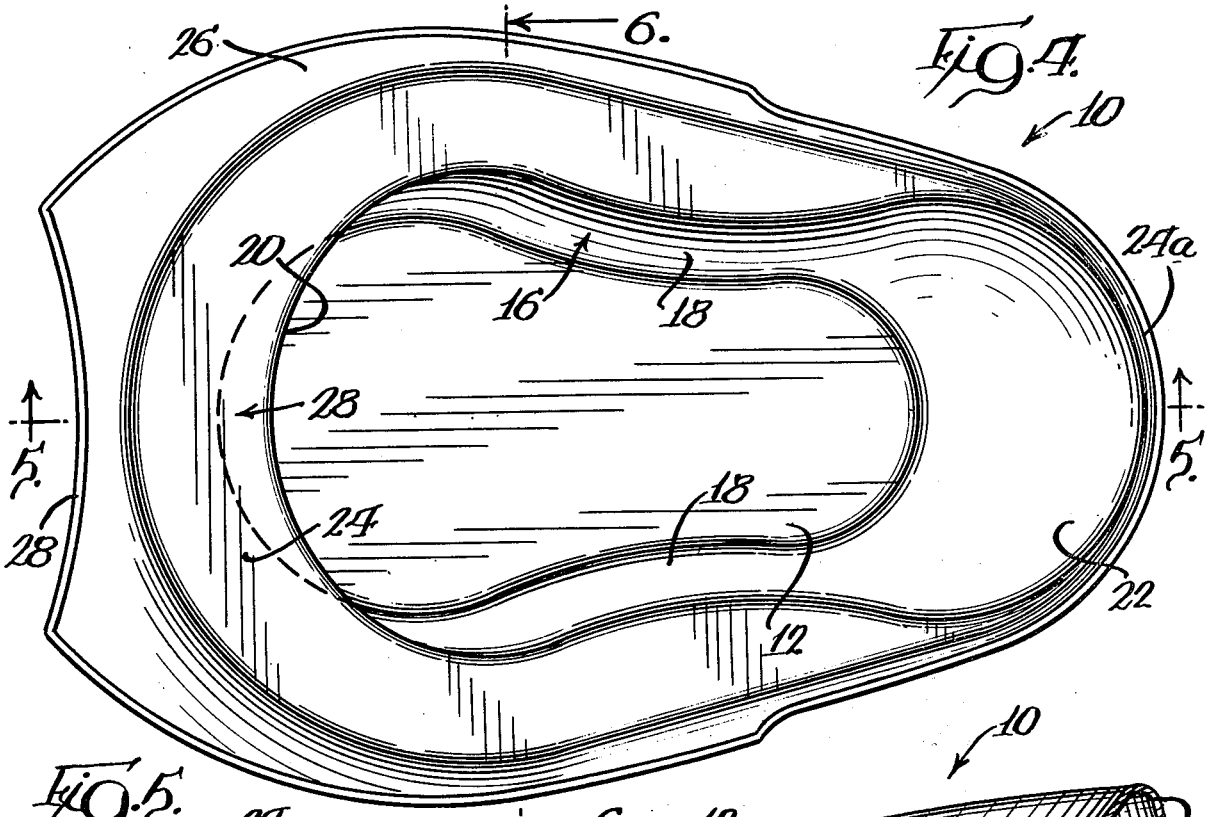
FIG. 4 is a plan view of the bedpan incorporating the present invention.
Figure 5:
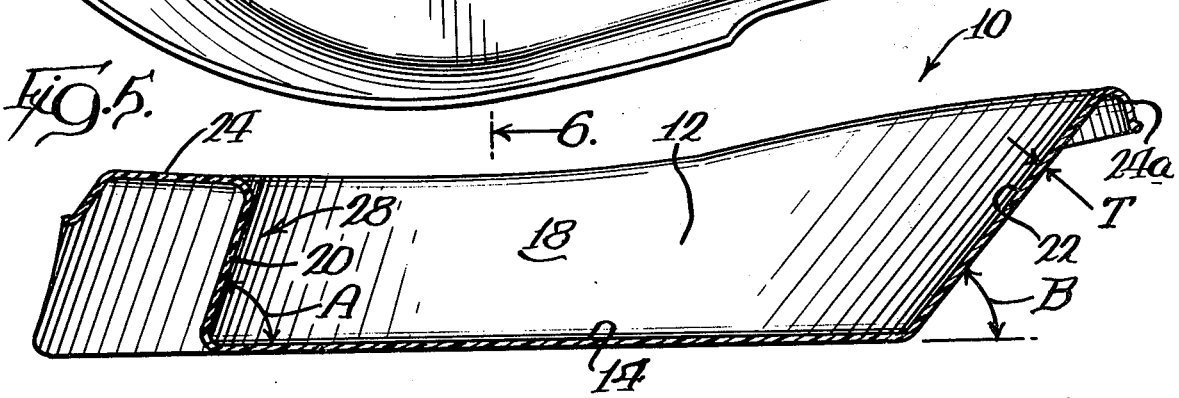
FIG. 5 is a sectional view taken along lines 5—5 of FIG. 4.

While this invention is susceptible of embodiment in many different forms, there is shown in the drawings and will herein be described in detail one specific embodiment, with the understanding that the present disclosure is to be considered as an exemplification of the principles of the invention and is not intended to limit the invention to the embodiment illustrated.

Figure 6:
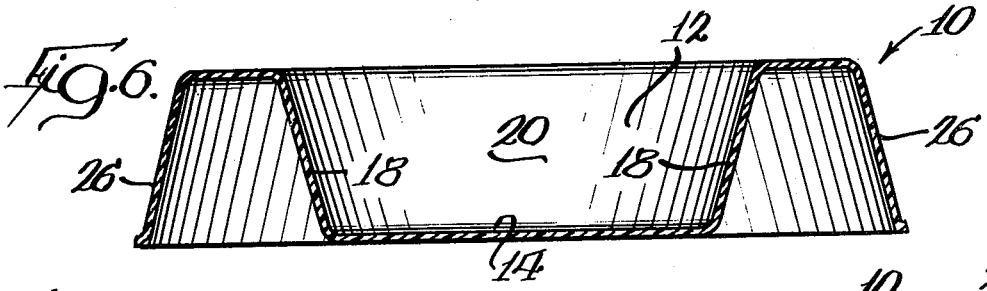
FIG.6 is a sectional view taken along lines 6—6 of FIG. 4.
Figure 7:
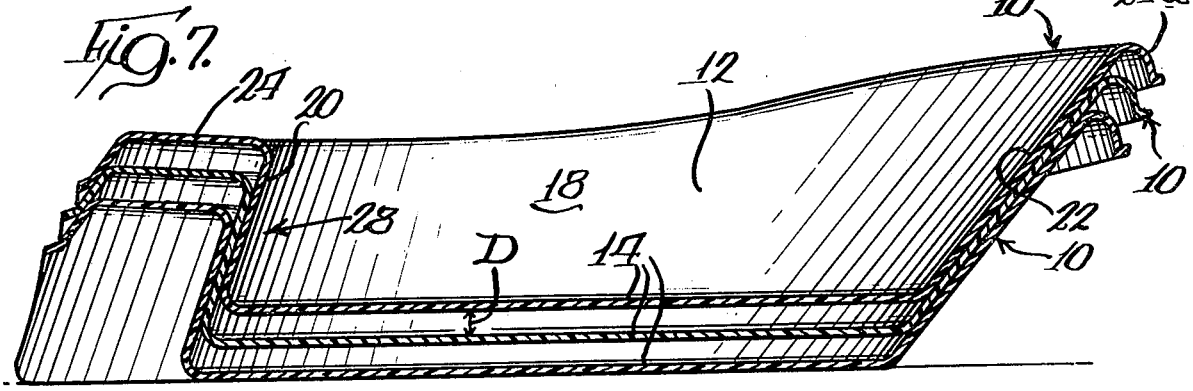
FIG. 7 is a sectional view similar to FIG. 5 showing the nestability of a plurality of bedpans incorporating the present invention.

FIGS. 2—6 are various views of a bedpan 10 incorporating the present invention and FIG. 7 shows the nestability of such bedpans. Nestability of bedpans incorporating the present invention should be distinguished from prior art bedpans having undercuts. For example, as shown in FIG. 1 bedpans of the type disclosed in the above-cited Rickmeier U.S. Pat. No. 3,597,771 which is representative of the type of bedpans now made for single-patient use and incorporating an undercut portion, do not nest. The rear of such bedpans form an undercut portion defined by an inwardly extending portion of the bedpan seat which, as shown in FIG. 1, precludes nesting and thereby increases the volume required for storage.

With respect to stackability of bedpans as shown in FIG. 1 of this application (which corresponds to FIG. 9 of the Rickmeier patent), it is clear that when one such bedpan is placed on top of another, the forward end of the upper bedpan fits partially within the bedpan below. However, the rearward portion of the upper bedpan sits on the seat portion at the rear of the lower pan. While this type of bedpan may stack, it clearly doesn't nest.

Any reduction in the space required to store a plurality of this type of bedpan, as compared to the space required to store the earlier bedpans such as those disclosed in the aforementioned Saulson U.S. Pat. No. 3,246,344 and Jones Patent No. D-173,490, is patently minimal. Compared to the nestability of the bedpan incorporating the present invention as illustrated in FIG. 7, any improvement in storage requirements resulting from use of the type of bedpan shown in FIG. 1 is more imaginary than real.

However, such bedpans have been widely used because of their relatively low cost and because they do inhibit splashback and spillage.

As shown in the drawing, the bedpan 10 incorporating the present invention includes a cavity defining a receptacle portion 12 defined by a generally planar bottom wall 14 and a continuous upright wall 16 extending up from the peripheral edge of the bottom wall 14. The upright wall 16 can be described as having a pair of opposed sidewall segments 18, and opposed end wall segments including a back undercut wall segment 20 and a front wall segment 22. In the disclosed embodiment, the various wall segments 18, 20, 22 blend one into the other to define the generally continuous upright wall 16 although the various segments of the upright wall do differ, as described below.

Extending outwardly from the upper peripheral edge of a major portion of the upright wall 16 is a horizontally extending flange or seat member 24 which tapers to an curvilinear bead-shaped flange **24*a* at the upper edge of the front wall segment 22. The downwardly extending part of the bead or flange 24*a* at the forward edge of the bedpan 10 enlarges as it extends rearwardly to define a stabilizer wing 26 extending generally downwardly from the outer peripheral edge of the seat member 24. The back of the stabilizer wing 26 may be cut out as shown at 28 to define a handgrip for carrying the bedpan. The front bead 24*a*** not only provides strength to the structure at that point but also acts in the nature of a pouring spout to inhibit dripping when the contents of the bedpan are disposed of.

As shown in the drawing, both the back wall segment 20 and the front wall segment 22 of the upright wall 16 taper forwardly from the point where they merge into the periphery of the bottom wall 14. However, the angle "A" between the back wall segment 20 and the bottom 14 and the angle "B" between the front wall segment 22 and the plane defined by the bottom 14 are different (See FIG. 5).

For example, in the illustrated embodiment, the angle "A" between the back wall segment 20 and the bottom 14 is approximately 70 degrees, whereas the angle "B" between the front wall segment 22 and the plane defined by the bottom 14 is about 50 degrees, some 20 degrees less. This difference in the angles of intersection between the front and back wall segments and the plane defined by the bottom wall permits a plurality of identical bedpans to nest.

The forward taper of the back wall segment 20 defines the undercut 28 to inhibit splashback and spillage of contents when the bedpan 10 is being moved. The configuration of the front and back wall segments being slanted in the same general direction but at different angles is different from the usual configuration of nestable products. In such products the opposed walls are normally tapered towards each other in a manner similar to the sidewall segments 18 of the bedpan as seen in FIG. 6 and the stabilizer wing 26, also as clearly shown in FIG. 6.

The difference in the angles between the front and the back wall segments 22, 20, together with the thickness 'T' of the material (See FIG. 6) determines the depth 'D' of the nest of one bedpan 10 within the other. Thus, the distance 'D' between the bottoms of nested bedpans, i.e., the degree of nest is a function of the angle 'A' of the back wall segment 20, the angle 'B' of the front wall segment 22, the difference between these two angles, as well as the thickness 'T' of the material. That relationship may be defined by the equation:

$$D = T(\sin A + \sin B)/\sin (A\text{-}B)$$

wherein:

'D' equals the degree of nest, i.e., (the distance between the bottoms 14 of adjacent nested bedpans 10);

',T' equals the thickness of the material from which the bedpans 10 are made;

'A' equals the angle between the plane defined by the bottom 14 of the bedpan and the back wall segment 20; and 'B' equals the angle defined between the plane defined by the bottom 14 and the front wall segment 22.

Thus, in one embodiment, the thickness 'T' of the material was approximately 0.075 inches, the angle 'A' of the back wall was approximately 70 degrees, and the angle 'B' of the front wall was approximately 50 degrees. The resulting degree of nest i.e., the distance 'D' between the bottoms 14 of adjacent bedpans, was approximately 0.375 inches.

While the relative angles and the differences therebetween determines the degree of nest, the selection of these angles may be limited by other considerations. Thus, as is clear from FIG. 7, the more bedpans that are nested, the greater the front of the top bedpan overhangs the forward edge of the bottom bedpan. Thus, the smaller the angle 'B', the greater the amount of overhang. To minimize overhang, the angle 'B' and therefore the angle 'A' would be increased.

At the same time, the angle of the rear wall segment 20 must be selected to provide an adequate undercut 28 to achieve the desired splashback and anti-spillage capabilities. For this purpose, the smaller the angle 'A', and therefore the angle 'B' the greater the undercut. Some accommodation is required between minimum overhang and maximum undercut.

Finally, to the extent possible, it is desirable to minimize the height of the stack, i.e., to reduce the nesting distance 'D' or increase the degree of nest, as much as possible. This mandates a certain relationship between the front and backwalls 22, 20. In order to define an undercut, and provide nestability, both the front and back walls must define similar but different acute angles with respect to the plane defined by the bottom wall. This differs from the usual nestable configuration wherein one wall defines an acute angle and the other defines an obtuse angle, i.e., the angles lie in different quadrents.

Thus, in the bedpan incorporating the present invention, both walls of the at least one pair of opposed wall segments one of which defines the undercut are tapered at an acute angle with respect to the bottom wall, i.e., are in the same quadrant or are on the same side of a line perpendicular to the plane of the bottom wall.

Thus, there has been disclosed, a unique, nestable, moldable bedpan provided with an undercut portion to inhibit splashback and spillage in which one pair of opposed upright wall segments define acute angles in the same quadrant with respect to a plane defined by the bottom wall, and in which the difference between those two angles is sufficiently great to permit nesting of a plurality of identical bedpans one within the other.

The bedpan incorporating the present invention solves the long-felt need for a bedpan which is inexpensive and therefore suitable for single-patient use, which is nestable to truly minimizes storage space, and which simultaneously provides a desired undercut to inhibit spillage and splashback.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. A single patient use bedpan comprising:

a cavity defining a receptacle portion and formed by a bottom wall and an upright wall extending from the peripheral edges of said bottom wall;

a seat member extending outwardly from a major part of the upper peripheral edge of said upright wall, said seat member merging into a peripheral bead formed on the remaining part of said upper peripheral edge of said upright wall portion; and a stabilizing member extending downwardly from the outer peripheral edge of said seat portion the lower edge of said stabilizer portion terminating substantially in the plane of said receptacle bottom;

said upright wall defining a pair of opposed side wall segments and a pair of opposed end wall segments;

said side wall segments and one of said end wall segments tapering downwardly and inwardly and the other of said end wall segments tapering downwardly and outwardly to define an undercut to inhibit splashback and spillage during transportation of said bedpan the acute angle defined between said other undercut defining endwall segment and said bottom wall being greater than the acute angle defined between said one endwall segment and said bottom wall;

a plurality of said bedpans being nestable one within the other.

2. A bedpan as claimed in claim 1 wherein the angles at which said end wall segments taper with respect to said bottom wall differ by an amount sufficient to permit nesting of a plurality of said bedpans one within the other.

3. A bedpan as claimed in claim 2 wherein the angles at which said end wall segments taper and the difference therebetween are determined as a function of the degree of nest desired and the thickness of the material from which said bedpan is made.

4. A bedpan as claimed in claim 3 wherein the angles at which said end wall segments taper is selected in accordance with the formula:

$$D=T(\sin A+\sin B)/\sin (A\text{-}B)$$

wherein:

D = the degree of nest—the distance between the bottoms of adjacent nested ones of said bedpans;
T = the thickness of the material from which the bedpan is made;
A = the acute angle between the bottom wall and the end wall segment defining the undercut;
B = the acute angle between the bottom wall and the end wall segment opposite to said undercut defining end wall segment; and
the angle A is larger than the angle B.

5. A bedpan as claimed in any of the above claims wherein the material from which said bedpan is made is a plastic and said bedpan is injection-molded.

6. An injection-molded, nestable bedpan comprising:
a cavity defining a receptacle portion and formed by a bottom wall and a tapered upright wall extending from the peripheral edges of said bottom wall;
a seat member extending outwardly from a major part of the upper peripheral edge of said upright wall; and
said upright wall defining a pair of opposed side wall segments and a pair of opposed end wall segments, one of said end wall segments tapering in a direction to define an undercut to inhibit splashback and spillage during transportation of said bedpan, the other of said end wall segments and said side wall segments tapering downwardly and inwardly, the acute angle defined between said one undercut defining end wall segment and said bottom wall being greater than the acute angle defined between the other end wall segment and said bottom wall;
a plurality of said bedpans being nestable one within the other.

7. The bedpan as claimed in claim 6 wherein a plurality of said bedpans are nestable one within the other.

8. A plurality of bedpans as claimed in claim 1 nested one within the other.

9. A plurality of bedpans as claimed in claim 6 nested one within the other.

10. A bedpan as claimed in claim 6 wherein the angles at which said end wall segments taper is selected in accordance with the formula:

$$D=T(\sin A=\sin B)/\sin (A\text{-}B)$$

wherein:

D = the degree of nest—the distance between the bottoms of adjacent nested ones of said bedpans;
T = the thickness of the material from which the bedpan is made;
A = the acute angle between the bottom wall and the end wall segment defining the undercut;
B = the acute angle between the bottom wall and the end wall segment opposite to said undercut defining end wall segment; and
the angle A is larger than the angle B.

11. A single patient use bedpan comprising:
a cavity defining a receptacle portion and formed by a bottom wall and an upright wall extending from the peripheral edges of said bottom wall;
a seat member extending outwardly from a major part of the upper peripheral edge of said upright wall, said seat member merging into a peripheral bead formed on the remaining part of said upper peripheral edge of said upright wall portion; and
a stabilizing member extending downwardly from the outer peripheral edge of said seat portion the lower edge of said stabilizer portion terminating substantially in the plane of said receptacle bottom;
said upright wall defining a pair of opposed side wall segments and a pair of opposed end wall segments;
said side wall segments and one of said end wall segments tapering downwardly and inwardly and the other of said end wall segments tapering downwardly and outwardly to define an undercut to inhibit splashback and spillage during transportation of said bedpan;
the angles at which said end wall segments taper being selected in accordance with the formula:

$$D=T(\sin A+\sin B)/\sin (A\text{-}B)$$

wherein:

D = the degree of nest—the distance between the bottoms of adjacent nested ones of said bedpans;
T = the thickness of the material from which the bedpan is made;
A = the acute angle between the bottom wall and said other end wall segment defining the undercut;
B = the acute angle between the bottom wall and said one end wall segment opposite to said undercut defining end wall segment; and
the angle A is larger than the angle B; and
a plurality of said bedpans being nestable one within the other.

* * * * *